US006343493B2

(12) United States Patent
Petty

(10) Patent No.: US 6,343,493 B2
(45) Date of Patent: Feb. 5, 2002

(54) ALIGNMENT SYSTEM FOR PATTERNING DEVICE

(75) Inventor: Larry K. Petty, Gastonia, NC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/821,912

(22) Filed: Mar. 30, 2001

Related U.S. Application Data

(60) Provisional application No. 60/193,716, filed on Mar. 31, 2000.

(51) Int. Cl.[7] ..... D06B 1/02
(52) U.S. Cl. ..... 68/205 R
(58) Field of Search ..... 68/205 R; 118/314, 118/315

(56) References Cited

U.S. PATENT DOCUMENTS

| | | | | |
|---|---|---|---|---|
| 3,939,675 A | | 2/1976 | Klein | 68/205 |
| 4,055,868 A | | 11/1977 | O'Neill, Jr. | 8/150 |
| 4,111,012 A | | 9/1978 | O'Neill, Jr. | 68/205 R |
| 4,309,881 A | | 1/1982 | Kimble | 68/205 |
| 4,584,854 A | * | 4/1986 | King | 68/205 R |
| 4,923,743 A | | 5/1990 | Stewart, Jr. | 427/288 |
| 5,161,395 A | * | 11/1992 | Wethington | 68/205 R |
| 5,208,592 A | | 5/1993 | Johnson, Jr. | 341/63 |
| 5,325,556 A | * | 7/1994 | Stewart, Jr. et al. | 68/205 R X |

* cited by examiner

*Primary Examiner*—Philip Coe
(74) *Attorney, Agent, or Firm*—Terry M. Moyer; George M. Fisher

(57) ABSTRACT

This disclosure relates to an improved system for mounting and aligning, in a manner that is both accurate and precise, an array of tubes used for delivering relatively small quantities of air or other fluids in various applications, as, for example, in patterning systems in which a stream of a patterning fluid such as a liquid dye is deflected from a trajectory by the impingement of a stream of a control fluid such as air.

5 Claims, 5 Drawing Sheets

ALIGNMENT SYSTEM FOR PATTERNING DEVICE

This application is a Continuation of Provisional Application No. 60/193,716, dated Mar. 31, 2000.

This disclosure relates to an improved system for mounting and aligning, in a manner that is both accurate and precise, an array of tubes used for delivering relatively small quantities of air or other fluids in various applications, as, for example, in patterning systems in which a stream of a patterning fluid such as a liquid dye is deflected from a trajectory by the impingement of a stream of a control fluid such as air.

A variety of commercially viable methods and associated machines for coloring or patterning webs of materials are known. Among such methods is that in which a plurality of individual dye jets are arranged in a linear array, referred to as a gun bar, that is positioned across the path of a moving web of a substrate to be patterned, most commonly a textile substrate such as fabric or carpeting. In one well-known system, that described in detail in commonly assigned U.S. Pat. No. 4,055,868 (O'Neill, Jr.), U.S. Pat. No. 4,111,012 (Stewart, Jr.), and U.S. Pat. No. 5,208, 592 (Johnson, Jr.), all hereby incorporated by reference herein, the dye jets are positioned so that each individual dye stream from a respective dye jet is directed continuously onto the surface of the moving substrate web, unless the stream is deflected or otherwise interrupted by a stream of control fluid from a corresponding array of control fluid tubes that are positioned in close proximity to the emerging stream of dye from the dye jets. The individual streams of control fluid, in this case, air, are formed by a linear army of control tubes, preferably positioned in accordance with the teachings herein across the path of a moving web of textile material, so that each control tube in the array is precisely aligned with a corresponding stream of dye that is directed onto the surface of the moving web by the dye jet associated with that control tube. In accordance with electronic patterning information, pressurized air (or other control fluid) is sent through one or more of the control tubes comprising the control tube array. Because of the alignment achievable using the teachings herein, air streams emerging from any of the tubes comprising the control tube array will precisely intersect the trajectory of the dye stream and interrupt or deflect the dye stream sufficiently to prevent the stream from contacting the surface of the web for a time period corresponding to the duration of the activation of the 'control stream. Each dye jet array or gun bar is supplied with dye of a different color, and, by careful choice of the colors used to supply each array, and by using various techniques for mixing or blending the various colors on the substrate, a wide variety of different colors can be generated. By actuating individually each of the dye jets in each of the various arrays over different time intervals (thereby applying different quantities of dye in various locations on the substrate), patterns of considerable complexity may be generated.

The development described herein is also believed applicable to other discrete dye applicator patterning devices in which transverse control streams are used to control streams of colorants, such as that described in commonly assigned U.S. Pat. No. 4, 923,743 to Stewart, Jr., which is hereby also incorporated by reference.

In the systems described in the above-referenced U.S. patents, the individual actuation of the dye jets is controlled by an electronic computer, which converts a desired pattern into a series of firing commands for the control streams associated with each of the individual dye jets in each of the arrays, taking into account the speed of the web as it passes under each of the arrays, the inter-array spacing, the requirements for in situ blending of various dyes to achieve the desired color as required by the patterning instructions, and other factors. As described above, a control tube adapted for carrying bursts of a pressurized control fluid is uniquely associated with each of the individual dye jets. The control tubes are oriented to provide a conduit for a stream of control fluid that is in a transverse orientation to the stream of dye emerging from the dye jet. When actuated, the stream of control fluid—which may be air or other fluid—intersects the stream of dye early in its trajectory and thereby diverts the dye stream and prevents the stream from contacting the substrate. The requirements surrounding the formation and delivery of this control stream will be discussed in greater detail below.

Important for the accurate reproduction of a desired pattern or color on a substrate is the precise and accurate delivery of the dye or other patterning fluid onto the moving substrate. In the various systems described in the above-referenced U.S. patents, that delivery not only depends upon accuracy and precision in the formation of a stream of dye, but also in the formation of an intersecting control stream that, as required, can intersect the dye stream and disrupt its trajectory onto the substrate. By so doing, the flow of dye onto the substrate may be crisply interrupted in accordance with patterning data, perhaps to be diverted into a dye recirculation system for that jet array.

The formation of such carefully formed and aimed controlled control streams can be achieved using a number of different mechanical approaches. For example, a manifold can be cast or machined with a series of apertures through which the pressurized control fluid may pass. An alternative approach that may be better suited for the formation of such fluid streams in tight quarters, or where such streams must be brought into close and precisely aligned relationship with other fluid streams, utilizes a series of aligned tubes, preferably rigid tubes, that are individually connected to a source of pressurized fluid, most frequently by means of small flexible tubes. While the use of such individual tube-based systems can afford great flexibility in the positioning of the resulting fluid streams, and can result in positioning the emerging control streams in close proximity to the dye streams they are intended to control, such systems can be subject to problems in arranging the rigid tubes in a properly aligned array, as well as problems in protecting such small diameter tubes from becoming bent.

In the past, such control stream tubes have frequently been aligned using an alignment plate having a series of precisely machined V-shaped notches, with the centerline (i.e., the axis of symmetry) of each notch corresponding to the axis of the dye stream to be controlled. Each tube in the array is positioned within a respective V-notch, which has been sized to accommodate the diameter of the tube in a way that prevents the tube from being completely contained within the notch (i.e., the depth of the notch that will accommodate the tube is smaller than the diameter of the tube). To center and immobilize the tubes within each notch, a separate confinement plate is secured to the alignment plate, forcing the tubes into the notches. In theory, this should serve to maintain the tubes in solid contact with the sides of the respective notches, thereby centering them within the notches and, presumably, aligning the tubes in a uniformly spaced, linear array.

However, this prior art method for positioning and aligning control tubes, shown, for example, in U.S. Pat. No. 4,923,743, has been determined to be less than totally satisfactory, in that the tubes occasionally do not seat entirely within the notch, thereby resulting in a tube that is free to move within the notch. This causes both misalignment and variability in directing the control stream on an intersecting trajectory with the stream of dye from the dye jet, and results in noticeable pattern imperfections.

This disclosure addresses a system by which an army of tubes, designed to carry a control fluid such as air, can be arranged in precise linear fashion into discrete modules that can be replaced on a per-module bases, and by which any individual modules may be aligned with great precision and accuracy in relation to the respective set of dye streams to be controlled.

For purposes of this disclosure, the term dye jets shall refer to the array of orifices that direct a dye or other liquid colorant along a trajectory directed to the surface of the substrate to be colored. The term gun bar shall refer to an array of dye jets, and all dye supply and dye deflection equipment that is associated with that specific array. The term control jets shall refer to the array of orifices—in this case, tube orifices—that direct an intermittent stream of a control fluid such as air into the trajectory of the dye emanating from the dye jets. In a preferred embodiment, the patterning apparatus to which this invention is directed is comprised of a plurality of gun bars, each associated with a different color dye, that are positioned in spaced relation across the path of a moving web of textile material.

DESCRIPTION OF PREFERRED EMBODIMENTS

Figure 1:
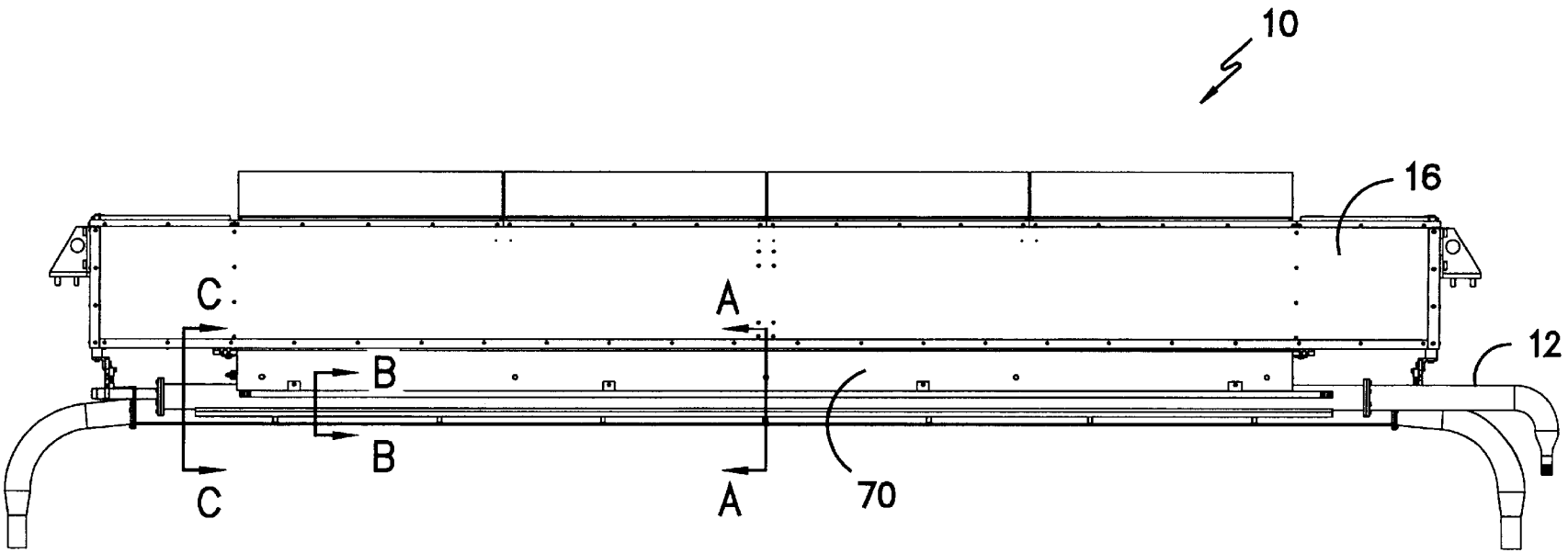
FIG. 1 is a plan view of one of the gun bars of the patterning device described herein, with which is associated the control tube module disclosed herein.

FIG. 1 shows an example of a single gun bar for a patterning device as contemplated herein. Both dye jet formation and control stream generation for a given color dye is performed within this gun bar. In a typical working device, several such gun bars are uniformly spaced along and positioned across the path of a moving web of textile material such a decorative fabric or a floor covering material, in parallel relationship with one another. Each such gun bar is typically supplied, via conduits 12, with a liquid dye of a different color, the number of gun bars thereby corresponding to the number of different colors available for application to the substrate. Reaction beam 70, described in more detail below, is used to support and align the gun bar in a position across the path of the moving textile web. Box 16 encloses the electronically actuated valves used to control the flow of the control fluid.

Figure 2:
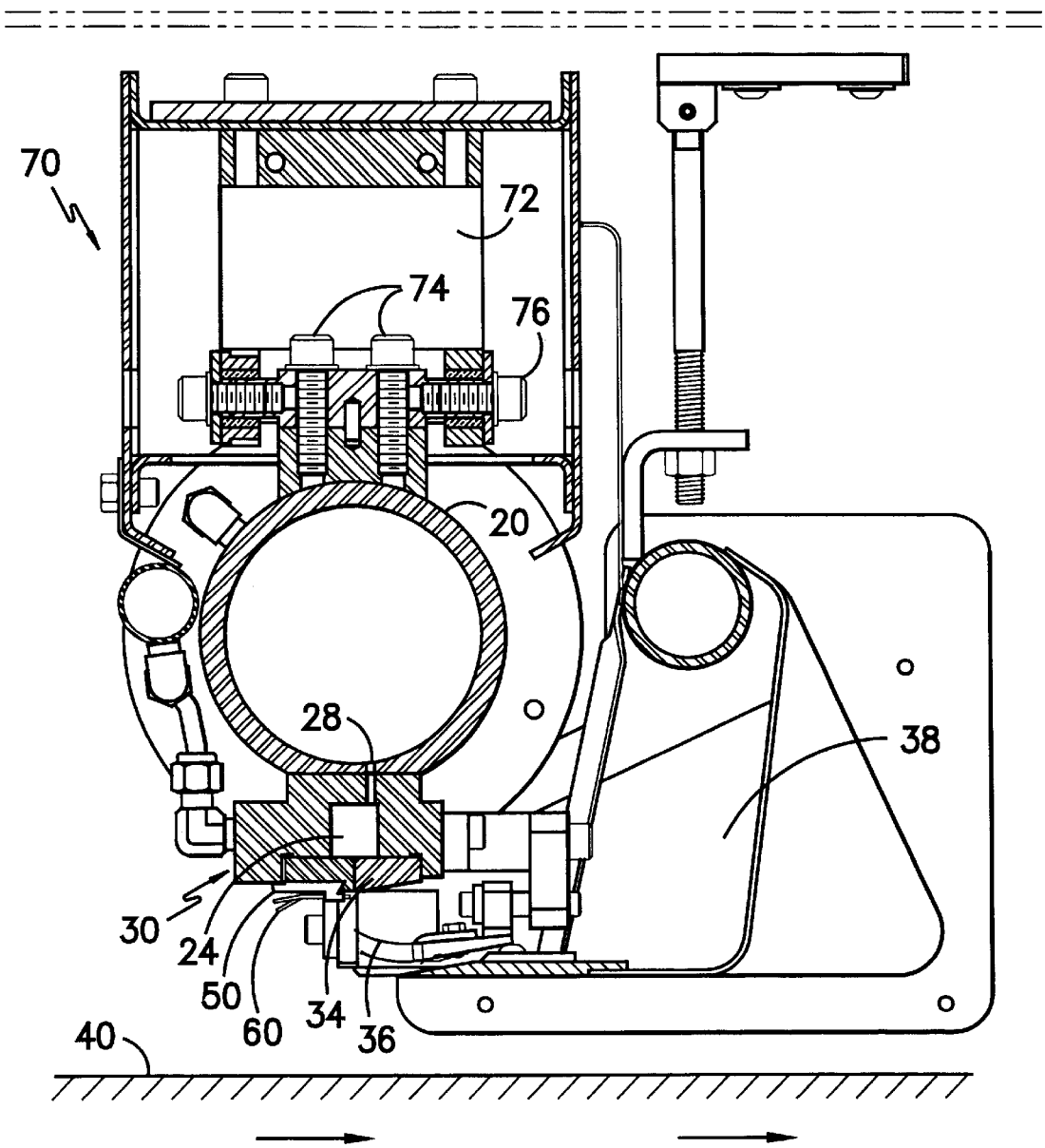
FIG. 2 is a cross-sectional view of the gun bar of FIG. 1 along section A—A.

FIG. 2 is a cross-sectional view taken along lines A—A of FIG. 1. Primary dye manifold 20 extends across the width of the gun bar and provides a supply of pressurized liquid dye to cavity 24 which partially forms secondary dye manifold 30. One wall of secondary dye manifold is formed by orifice plate 34, which is attached to secondary dye manifold by machine screws or other suitable means. Orifice plate 34 is comprised of a linear array of orifices of uniform size, all of which are directed towards the path of the moving textile web. In the absence of any intersecting streams of a control fluid, the dye is directed from primary dye manifold 20 to secondary dye manifold 30, via channel 28, whereupon it is formed into a linear army of uniformly spaced and precisely formed dye streams or jets that are directed onto the surface of the moving textile web 40.

FIG. 2 also shows, in cross section, an array of individual control tubes 60 that are securely attached to control tube module 50 and are positioned generally perpendicular to the trajectory of the dye streams emanating from orifice plate 34. Each dye orifice has associated with it a control tube 60, which is precisely aligned with the dye stream from the respective orifice through use of the control tube modules and the alignment system disclosed herein.

In operation, each individual stream emerging from the orifice plate 34 passes in close proximity to the open end of a corresponding control tube 60, through which a stream or burst of pressurized control fluid such as air can be intermittently passed in accordance with electronically encoded patterning information. The electronically encoded patterning instructions are appropriately sequenced (to compensate for the relative positions of the various gun bars along the path of the substrate) and directed to the appropriate individual electrically actuated fluid valve associated with each control tube. When the valve associated with a given tube directs pressurized air through the control tube 60, the resulting control stream intersects the trajectory of the continuously flowing dye stream and diverts the dye stream sufficiently that the stream strikes shielding blade 36 and passes into dye collection trough 38 and into the dye recirculation system for that gun bar.

Also shown in cross-section in FIG. 2 is reaction beam 70, by which the alignment of the orifices in orifice plate 34 can be brought into precise alignment along a plane perpendicular to the substrate, so that the orifices form a straight line (or the resulting emerging dye streams define a plane) along the length of the gun bar. Beam 70 is a box girder-like structure that extends along the length of the gun bar. Within beam 70 are a series of flexible hangers 72 that are spaced along the length of the gun bar, from which are suspended primary dye manifold 20 by means of bolts 74 and clamps of convention design. Because flexible hangers allow movement along the length of the gun bar, but are resistant to movement in the direction of substrate movement, bolts 76, which act against hangers 72 in an edgewise direction, may be used to adjust the position of the manifolds 20 and 30 relative to the substrate to achieve proper alignment and the desired degree of perpendicularity with respect to the surface of substrate 40.

Figure 3:
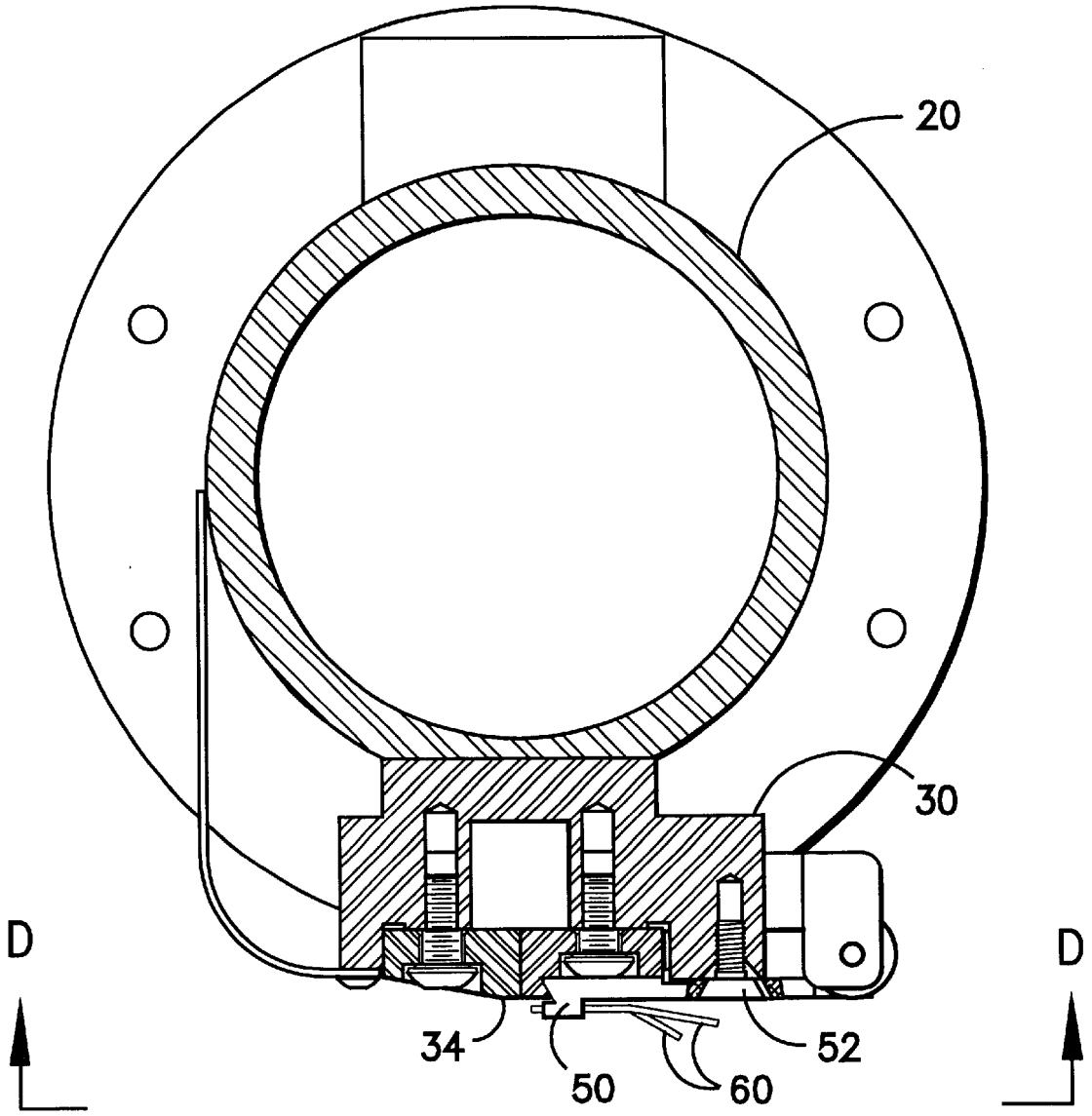
FIG. 3 is a cross-sectional view of the gun bar of FIG. 1 along section B—B.
Figure 4:
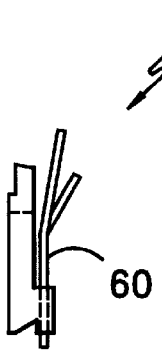
FIG. 4 is an end view of the control tube module.

FIG. 3 shows an end view of one of the control tube modules, shown in FIGS. 2 and 4, as it is positioned with respect to secondary dye manifold 30. As indicated, the module is comprised of a "Z"-shaped mounting plate 50, through the lower portion of which has been drilled an array of precisely sized and spaced bores. These bores, which in one embodiment are on the order of 0.042 inch in diameter spaced along 0.050 inch centers, are intended to accommodate individual tubes having outside diameters of, for example, 0.041 inch, and to orient those tubes so that each tube is directed in precise alignment with a respective stream of dye generated by orifice plate 34. Because of the close adjacent spacing of the dye orifices 34, the bores must be spaced correspondingly closely to each other. In one embodiment, the bore-to-bore adjacent spacing is on the order of 0.050 inches, into each bore an individual control tube is inserted and secured with a metal-to-metal adhesive such as Loctite (manufactured by Loctite Corporation of Hartford, Conn.)

Figure 5:
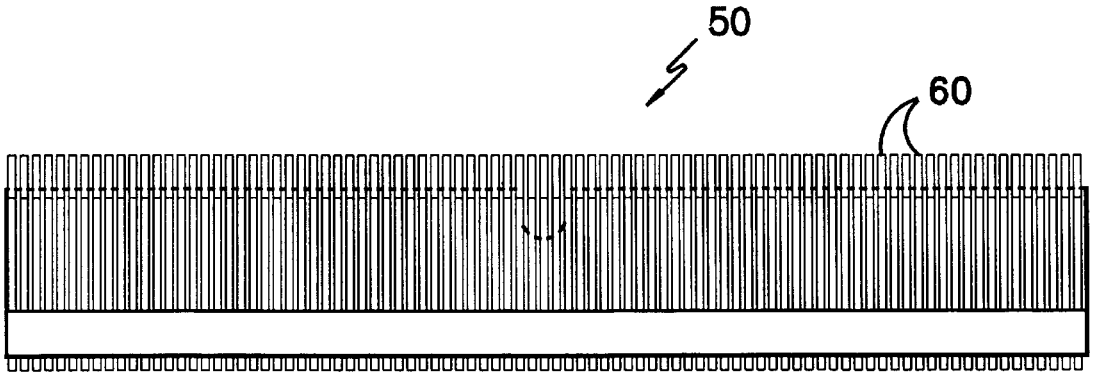
FIG. 5 is a substrate-side view of the control tube module of FIG. 4.

Such close adjacent spacing can make air supply connections to the individual tubes difficult; for that reason, the supply end of alternate tubes may be bent, as shown in FIGS. 3 and 4, to provide improved clearance for the necessary flexible supply tubes to be attached. In a preferred embodiment, each mounting plate may be configured as a module having a standard length, for example, 12 inches. A representative module is depicted from the substrate side and the machine side, respectively, in FIGS. 5 and 6. FIG. 4 shows the module of FIGS. 5 and 6 looking from one end of the module.

Module 50 is mounted onto the secondary dye manifold 30 by means of machine bolts 52 (see FIG. 3). As bolts 52 are tightened, they are configured to exert a lateral force on module 50 in the direction of the orifices in orifice plate 34 (e.g., to the left in FIG. 3). This allows the position of module 50 to be adjusted along the manifold axis direction. When the desired position is reached, bolts 52 are tightened, thereby forcing the leading edge of the "Z"-shaped module 50 to against the cooperatively shaped angular groove in the orifice plate 34, thereby locking the position of module 50 with respect to the orifices in orifice plate 34. Other conventional mechanisms that provide the ability to move and secure the module along the length of the secondary dye manifold (i.e., along the long axis of the gun bar) can also be used.

Figure 6:
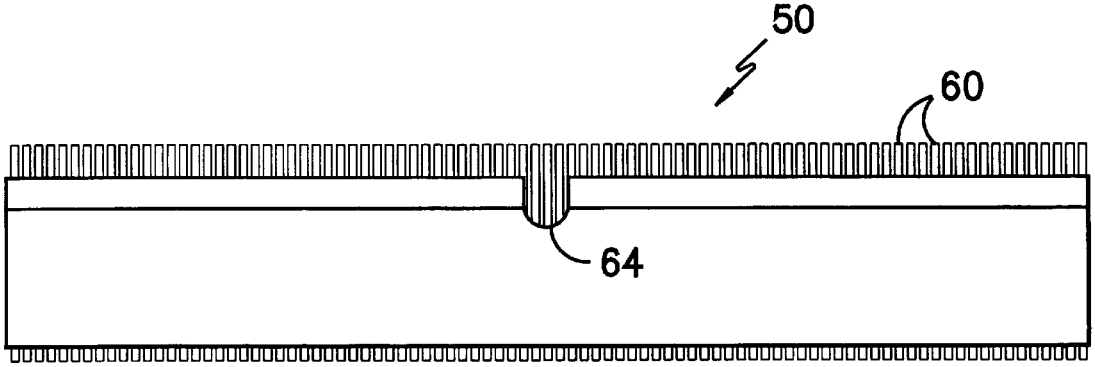
FIG. 6 is a machine-side view of the control tube module of FIG. 4.
Figure 7:
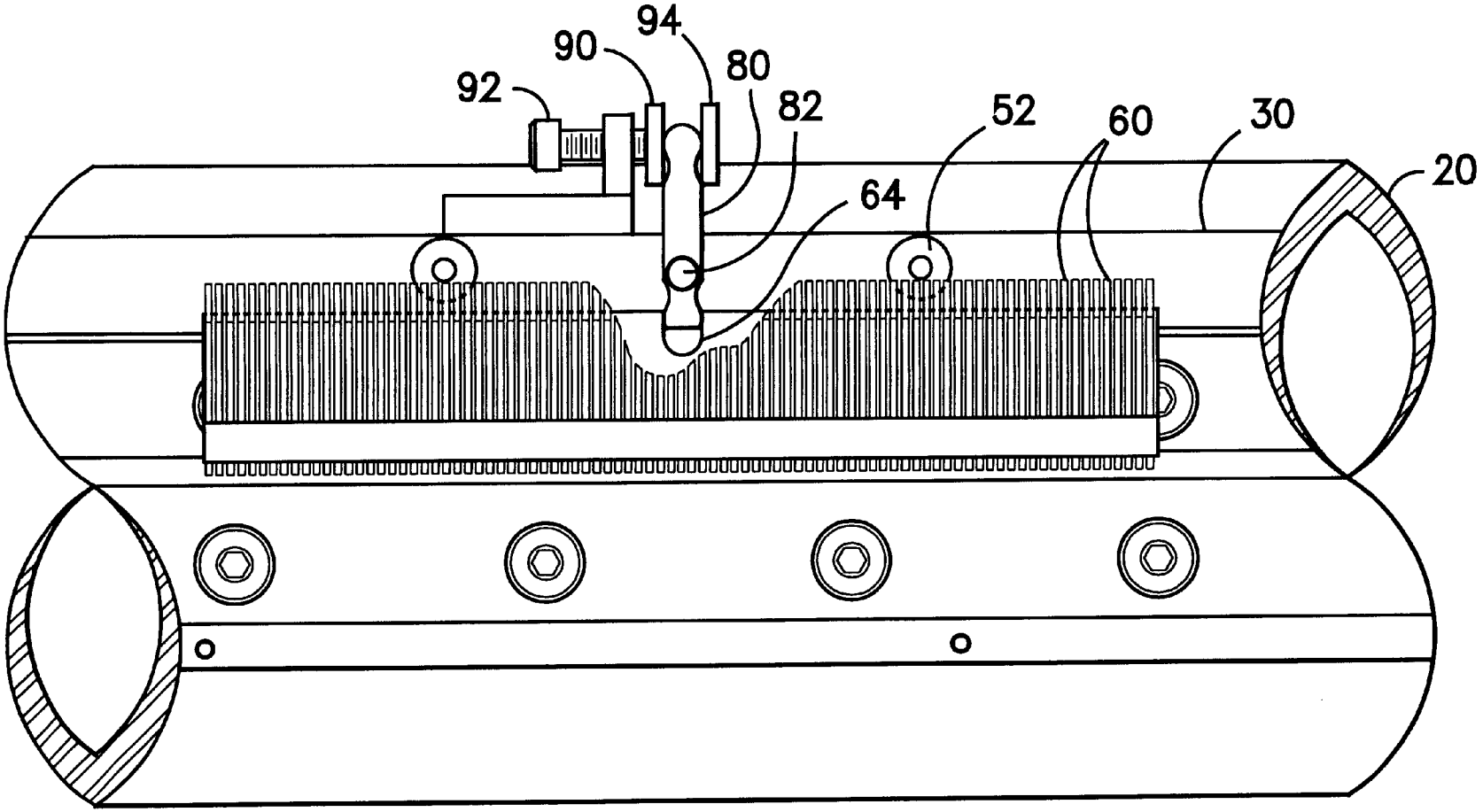
FIG. 7 is a substrata-side view of a control tube module of FIGS. 5 and 6, as seen mounted on the secondary dye manifold, as depicted along lines D—D of FIG. 3.

Regardless of the mechanism used, however, there remains an inherent difficulty in being able to reliably and precisely achieve very small adjustments in the lateral displacement of the module so as to assure optimum alignment between the control tubes 60 in the module and the respective dye streams flowing in front of each of the tubes 60. To solve this problem, positioning notch 64, which, in the preferred embodiment shown, is generally "U"-shaped, but can have other profiles, was placed along the module edge, on the machine side of "Z"-shaped module 50, as shown in FIG. 6. Co-acting with positioning notch 64 is pivoted positioning lever 80. Positioning lever 80 is attached to secondary dye manifold 34 by means of pivot 82, with one end of positioning level inserted into positioning notch 64 and the opposite, rounded end of positioning lever 80 being inserted into adjustment clamp 90.

Adjustment clamp 90 consists of an adjustment screw 92 that passes through a threaded stationary bolt attached to the outside surface of secondary dye manifold 30. Adjustment screw 92 has a spool 94 formed on one end which is sized to accommodate the rounded end of positioning lever 80 in a close, but not tightly fitting, relationship. Whenever there is a need for replacing the control tube module, or a need_for adjusting the alignment of the module with respect to the dye streams emerging from orifice plate 34, the module 50 may be precisely aligned by loosening bolts 52 used to secure the module 50 to the secondary dye manifold 30. The module may then be moved laterally by turning adjustment screw 92 in the desired direction. The sides of spool 94 press on lever 80 and induce lateral movement in module 50 in a highly controlled manner.

What is claimed is:

1. A patterning device for patterning a moving substrate in which a plurality of discrete streams of dye are formed by an array of dye jets positioned along the length of an elongate dye manifold, said manifold being positioned with its primary axis across the path of said substrate, said jets forming an array of parallel dye streams, extending across said substrate path, that are directed onto the surface of said substrate and, in accordance with pattern data, are deflected away from said substrate, said manifold being positioned by a reaction beam comprised of a box girder-like structure extending along the length of said manifold, said structure containing a series of flexible hangers spaced along the length of said manifold, each hanger having associated therewith suspending bolts and clamps with which said manifold may be suspended from said reaction beam, as well as a pair of adjustment bolts that act against said hangers in an edgewise direction and provide an alignment adjustment for said manifold, whereby said manifold may be adjusted to achieve proper alignment and perpendicularity with respect to the surface of substrate to be patterned.

2. The apparatus of claim 1 wherein said flexible hangers provide for movement along the length of said manifold, but not for movement in the direction of substrate movement.

3. A patterning device for patterning a moving substrate in which a plurality of discrete streams of dye are formed by an array of dye jets positioned along the length of an elongate dye manifold, said manifold being positioned with its primary axis across the path of said substrate, said jets forming an array of parallel dye streams, extending across said substrate path, that are directed onto the surface of said substrate and, in accordance with pattern data, are deflected away from said substrate by respective intersecting streams of a control fluid delivered by an array of control tubes positioned in front of, and in alignment with, said dye jets, wherein said alignment is achieved by a rectangular mounting plate, to which said control tubes are attached, said mounting plate being associated with and extending parallel to said primary axis of said dye manifold, said mounting plate having a front edge and a rear edge parallel to said front edge, said control tubes having orifices that are positioned in alignment along said rear edge, in front of respective dye jets, said front edge of said mounting plate having a positioning notch into which is inserted one end of a pivoted positioning lever operably associated with said dye manifold, the opposite end of said lever being inserted into a threaded means by which a lateral force may be exerted through said lever to said positioning notch, said force being directed to urging said mounting plate in a direction parallel to the primary axis of said dye manifold in a controlled manner, whereby said control tubes may be brought into lateral alignment with their respective dye jets.

4. The patterning device of claim 3 wherein said control tubes are attached to said mounting plate by being positioned within bores contained in said mounting plate.

5. The patterning device of claim 3 wherein said threaded means is comprised of an adjustment screw having a spool adapted to accommodate said opposite end of said lever, and wherein the sides of said spool press on said opposite end of said lever and induce lateral movement of said mounting plate.

* * * * *